United States Patent [19]

Helver

[11] Patent Number: 4,848,435

[45] Date of Patent: Jul. 18, 1989

[54] VERTICAL BLIND ASSEMBLY

[76] Inventor: Oscar Helver, 13501 SW. 81st, Miami, Fla. 33183

[21] Appl. No.: 266,590

[22] Filed: Nov. 3, 1988

[51] Int. Cl.[4] ..... E06B 9/26

[52] U.S. Cl. ..... 160/176.1; 160/178.1; 160/900

[58] Field of Search ..... 160/176.1, 168.1, 178.1, 160/900,

[56] References Cited

U.S. PATENT DOCUMENTS 4,122,884 10/1978 Salzmann ..... 160/168.1
4,267,875 5/1981 Koks ..... 160/176.1

*Primary Examiner*—Blair M. Johnson
*Attorney, Agent, or Firm*—Charles J. Prescott

[57] ABSTRACT

This invention relates to a vertical blind assembly of the type typically having a plurality of vertically oriented slats each supported from a carrier assembly in a manner which selectively provides for the angular orientation of each of the slats in synchronized relation to one another about their longitudinal axis and also for the travel of the slats and the associated and supported carrier assembly along the length of a header structure further within each of the carrier assemblies is structured to include a clutch mechanism which automatically provides for a realignment of any inadvertently displaced or jammed slates and associated support stems or components associated therewith and a simplified control means and end, rod support for attachment of a tilt rod for manipulating both the aforementioned angular orientation of the slats relative to one another and their travel along the length of the header structure.

18 Claims, 3 Drawing Sheets

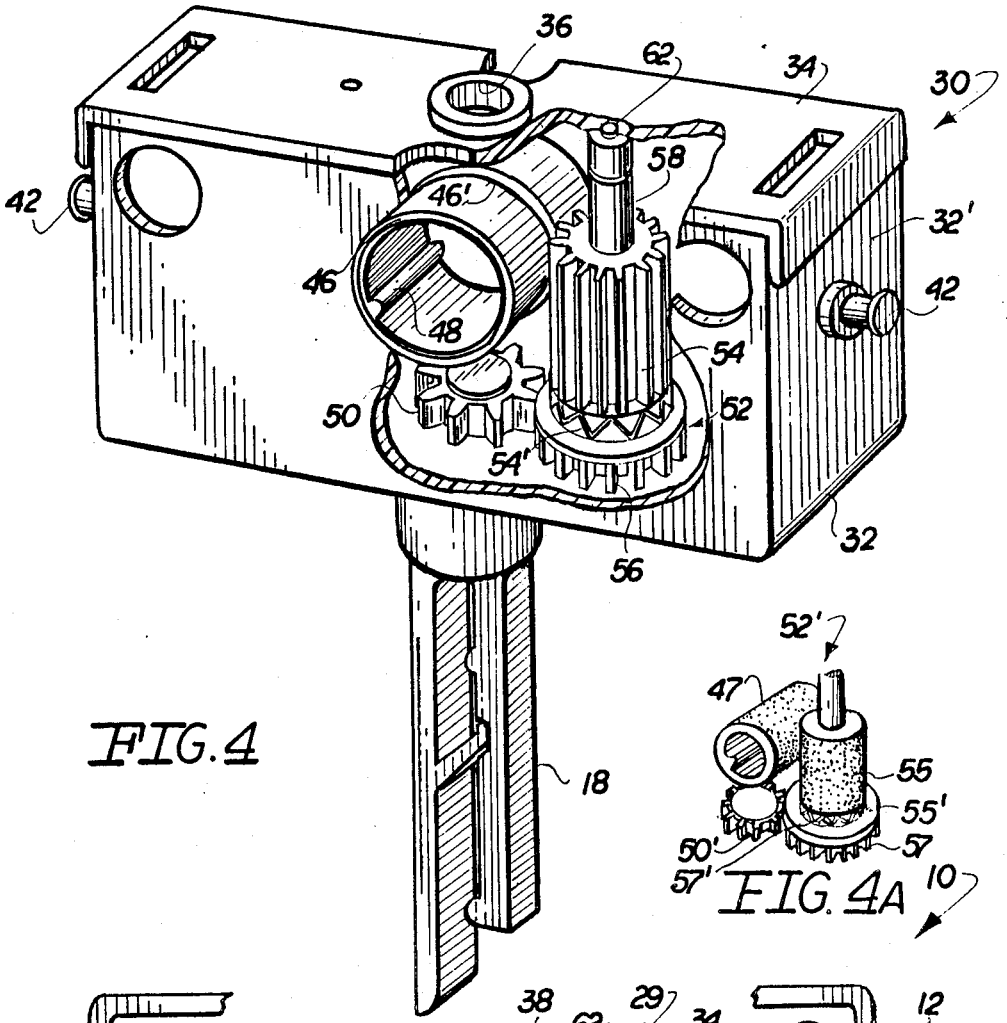
FIG. 4
FIG. 4A
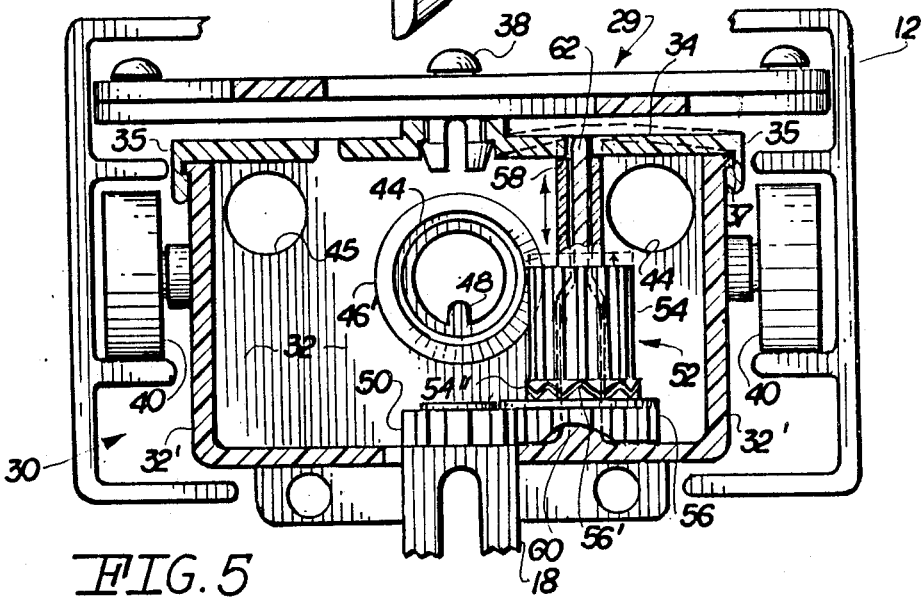
FIG. 5

VERTICAL BLIND ASSEMBLY

BACKGROUND OF THE INVENTION

1. Field of the Invention

This invention relates to a vertical blind assembly including specific structural components of the carrier frames and assemblies for the vertical support and selective movement of the slats relative to one another in a preferred synchronized angular orientation as well as the travel of such slats and respective carrier assemblies along the length of the supporting header structure.

2. Description of the Prior Art

Vertical blind assemblies or structures of the type incorporating a plurality of vertically oriented louvers or slats are well-known in the prior art. Typically, such assemblies include the vertical louvers being capable of traversing the length of a track or header structure extending over any type of expanse, portal, etc. Also, this type of assembly allows for the synchronized angular orientation or tilting of the slats collectively into a common angular orientation about their respective longitudinal axis. This angular orientation controls or regulates the amount of light or viewing through the individual slats. Vertical slats or blind assemblies of the type set-forth herein and well-known in the prior art generally include a carrier assembly or frame having a depending stem portion for the removable support of an uppermost end of each slat or vertically oriented louver. Individual carrier assemblies are positionable collectively along the length of the header or selectively retracted into a closely adjacent position. Such positioning depends on whether it is preferred to extend the vertical louvers along the entire length of the supporting track structure or alternately collect the louver at one end thereof so as to allow complete passage or access through the portal area which the vertical blind assembly is intended to over hang and possibly cover.

Numerous prior art structures are known which are specifically directed to the prior art of vertical blind assemblies. Such structures of the type referred to are the subject of U.S. Pat. Nos. 4,262,728; 4,122,884; 4,616,688; 4,267,875; 4,293,021; and 2,754,902. While the structures disclosed in such patents are considered to be operable for their intended and designed purposes, frequently, numerous prior art structures of the type set-forth therein are considered to be rather complex and therefore add to the initial expense of the vertical blind assembly as well as the cost of maintenance and/or repair of such structures. One problem generally recognized in prior art vertical blind assemblies of the type set-forth herein include the ability to realign inadvertently displaced slats such as when they become jammed or somehow become dislodged from their synchronized angular orientation relative to the remaining slats depending from the header structure. Accordingly, some type of clutch or realignment assembly should be associated with each of the carrier frames or assemblies which serve to support and attend to the angular disposition of the suspended slat without adding to the cost or complexity of the carrier frame structure itself and wherein the consuming public can rely on such an assembly to effectively realign all of the slats into the preferred synchronized angular orientation relative to one another in an efficient manner.

SUMMARY OF THE INVENTION

This invention relates to a vertical blind assembly of the type including an elongated header structure supporting a plurality of carrier assemblies wherein each carrier assembly is connected to an elongated tilt rod itself extending along the length of the header structure and supported thereon at least at opposite ends thereof. Interconnection of each carrier assembly to the elongated tilt rod allows a depending supporting stem which is removably connected to an upper end of a vertical slat or blind louver to be rotated such that each of the slats may be disposed at a predetermined, synchronized angular orientation relative to one another upon the rotation of the tilt rod. Rotation of the tilt rod occurs by the pulling of a pull chain assembly itself movably connected to and depending from a control means. The control means is removably mounted to one end of the header structure and serves to drivingly rotate as well as support the tilt rod at this corresponding end.

The control means further includes an additional depending pull cord which extends downwardly from the control assembly and passes back therethrough along the length of the header structure and effectively through and in engagement with each of the aforementioned carrier assemblies. By manipulation of the pull cord, each of the carrier assemblies and accordingly each of the vertical slats attached thereto may be selectively positioned along the length of the header structure.

Important features of the present invention which clearly distinguish it from numerous vertical blind assemblies in the prior art include but are not limited to the existence of the components associated with each carrier frame on each carrier assembly disposed and structured to attend to the rotation of the support stem and the vertical slat attached thereto. More specifically, a gear means is mounted on each of the carrier frames. Such gear means includes a worm gear disposed in surrounding relation to and engagement with the tilt rod. The tilt rod extends through a central aperture of each carrier frame and the worm gear associated with the tilt rod rotates therewith upon a manipulation of the pull chain assembly as set forth above. Similarly, the stem includes a stem gear attached to the upper end or head thereof.

An interconnecting gear assembly serves to drivingly interconnect the worm gear to the stem gear such that rotation of the tilt rod will cause the axial rotation of the stem and accordingly the vertical slat depending therefrom. The interconnecting gear assembly includes a first gear member drivingly engaging the worm gear of the tilt rod and a second gear member disposed in driving, mating engagement with the stem gear. These gear members are interconnected by mating gear segments which are specifically disposed, configured and dimensioned to mate with one another unless and until a sufficient force is exerted on the tilt rod and accordingly the worm gear and first gear member to cause a "riding-off" or displacement of the first gear segment relative to the second gear segment. A clutching action is thereby provided wherein the stem and/or slat supported thereby is prevented from rotation in a given direction or jammed and the tilt rod continues to rotate. In such a situation, the first gear segment will continue to move relative to the second gear segment which remains stationary. Accordingly, the first gear member rides-off the second gear member and is forced against a biasing member itself being defined by a cover mounted on and extending over the carrier frame. The biasing member serves to normally bias the first gear member into mating driving engagement with the second gear member. However, when such "riding-off" of the first gear member relative to the second gear member occurs, a clutch action is provided which serves to "automatically" realign all of the stems and of course, the supported, depending vertical slats thereon in the preferred synchronized angular orientation relative to one another. This is accomplished merely by pulling the pull cord in both of the two opposite directions in which it is intended, to its farthest extent. The clutching action will serve to thereby realign all of the stems and their depending vertical slats in a manner which will become more apparent upon further, more detailed description of the clutch mechanism including the aforementioned interconnecting gear assembly.

Other important structural features of the present invention are incorporated in the control means. The control means includes a sprocket gear rotatably mounted on the control frame and cooperatively driven by the aforementioned pull chain. The sprocket gear includes an inner end portion disposed within a central elongated channel of the control frame wherein the inner end portion of the sprocket gear matingly engages the correspondingly positioned end of the tilt rod and is secured thereto at least in part by the existence of a push nut which serves as a locking structure between an inner portion of the sprocket gear and the correspondingly positioned end of the tilt rod. Further, an end-cap serves to effectively cover the sprocket gear and preferably peripheral portions thereof are structured to define a removable snap-fitted engagement of the end-cap over the normally exposed end of the sprocket gear and in interconnection with the control frame. A pair of rollers are provided to define guide means for the pull cord assembly used to selectively position all of the carrier assemblies along the length of the header structure as set forth above. Further innersurface portions of the end cap have cord guide structures integrally formed thereon to ensure free unincombered travel of the cord in either direction as such cord cooperatively engages the aforementioned roller pair associated with and mounted on the control frame of the control means.

The opposite end of the tilt rod is supported on the header structure by a rod support means as set forth above. This rod support means includes an end-stop member itself engaging the correspondingly positioned end of the tilt rod associated therewith. Again, a push nut is mounted on the support end means associated with this corresponding end of the tilt rod and serving to engage the tilt rod and effectively establish an interconnection therebetween. An additional roller pair is rotatably mounted on the rod support means so as to rotatably engage and effectively guide a portion of the cord traveling about the rod support means regardless of the direction of travel. The end-cap also is specifically structured at an inner most extremity thereof to be snap-fitted into removable engagement with the remainder of the support control means and thereby be easily secured to and removed therefrom for repair or replacement without dismantling the entire structure.

BRIEF DESCRIPTION OF THE DRAWINGS

FIG. 4 is a perspective view of one carrier assembly in partial cut-away showing the various components included in the carrier assembly and associated with its operation.

FIG. 4A is a detail view in partial cut-away of another embodiment of the components of the carrier assembly shown in perspective view of FIG. 4.

FIG. 5 is a sectional view in partial cut-away of the embodiment of FIG. 4.

Like reference numerals refer to like parts throughout the several views of the drawings.

DETAILED DESCRIPTION OF THE DRAWINGS

As shown in the figures presented herein, the present invention is directed towards a vertical blind assembly generally indicated as 10 and including an elongated header structure 12 having a control means generally indicated as 14 secured to one end and a rod support means generally indicated as 16 secured to the opposite end. By virtue of structure contained in the respective control means and rod support means 14 and 16, each may be snap-fitted and removably connected in an efficient manner to the corresponding ends of the header structure 12 and thereby be readily removed, for repair or replacement without disassembly of the entire vertical blind assembly as is common with many prior art structures of this type.

Figures 1, 2, 3:
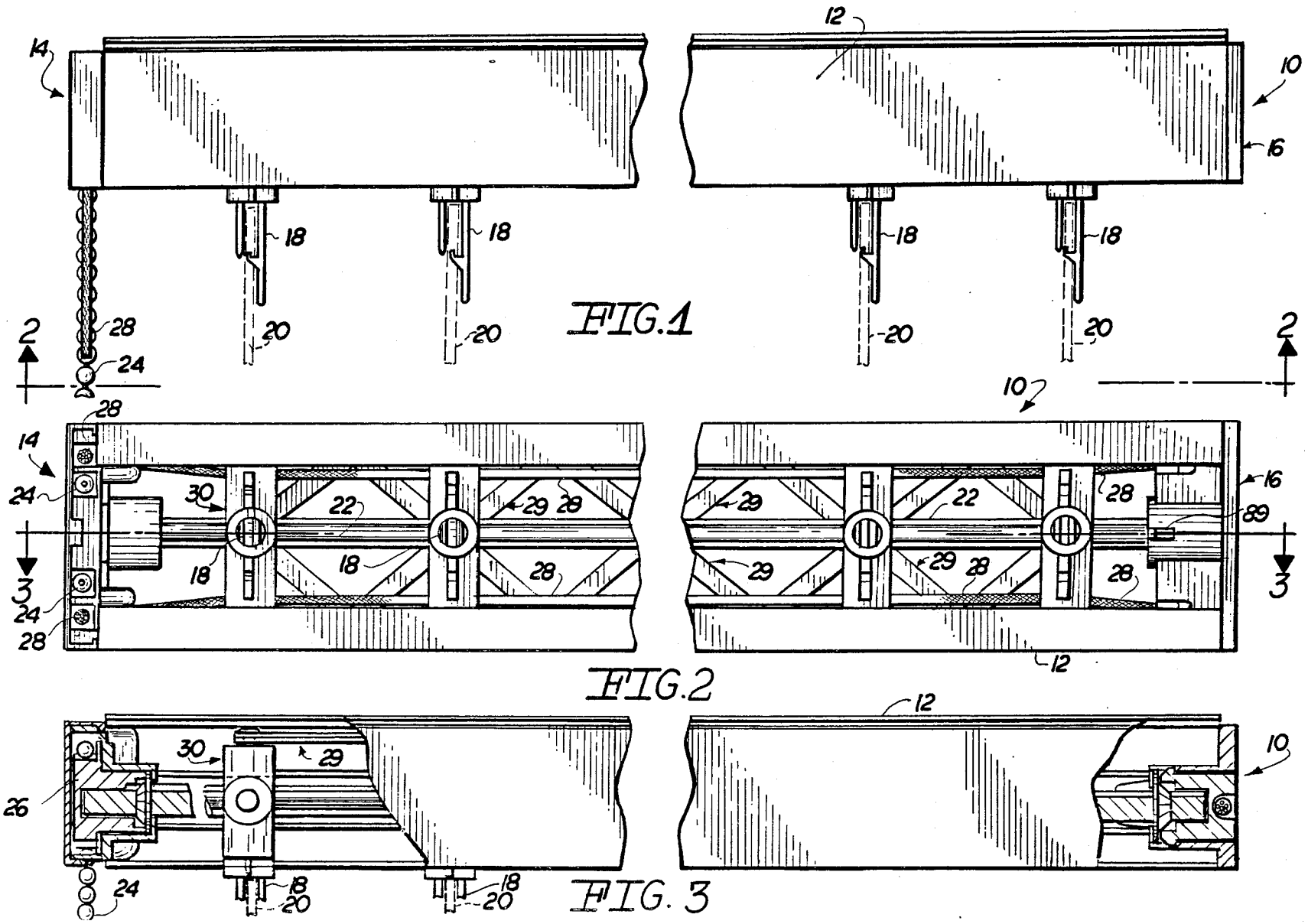
FIG. 1 is an elongated side elevation and partial cut-away of the header structure and other components of the vertical blind assembly of the present invention.
FIG. 2 is a bottom view along line 2—2 of the embodiment of FIG. 1.
FIG. 3 is a longitudinal sectional view along line 3—3 of FIG. 2.

Also shown in FIG. 1, a plurality of support stems 18 extend outwardly from a bottom end of the header structure 12 and are disposed and configured for removable engagement with a plurality of vertically oriented slats or louvers represented in phantom lines and indicated as 20. As shown in FIGS. 2 and 3, an elongated tilt rod 22 is mounted on the interior of the header structure and extends along the length thereof. The tilt rod 22 is rotatably supported at a correspondingly positioned end to the control means 18 and at an opposite end to the rod support means 16. As will be explained in greater detail hereinafter and is generally common to the vertical blind industry, the manipulation or pulling of an elongated pull chain 24 which is associated with various components of the control means 18 and in particular sprocket gear 26 attends to the rotation, along its own longitudinal axis, of the tilt rod 22. Also associated with the control means 14 and depending in exposed relation therefrom is an elongated cord means 28 which, is clearly shown in FIG. 2, extends along and is disposed in engagable but movable relation with each of a plurality of carrier assemblies. The carrier assemblies generally indicated as 30 and represented in detail in FIGS. 4 and 5, serves to movably support the stem 18 and of course, the vertical slats 20 depending therefrom. Manipulation of the cord means 28 will serve to selectively position the carrier assemblies 30 along the length of the header structure and of course along the length of the tilt rod 22. Each of the carrier assemblies are interconnected by a conventional and well-known accordion or scissor-type interconnection assembly 29.

With reference to FIGS. 4 and 5, each of the carrier assemblies 30 comprises a carrier frame 32 configured into somewhat of a box-like structure as clearly shown in FIG. 4 and including an overlying cover 34 secured in what may be considered a snap-fitted engagement by depending flanges 35 engaging outer protuberances 37. Further, the cover member 34 is centrally apertured as at 36 to receive a connector 38 which serves to interconnect the carrier assembly 30 with the interconnecting expandible member 29 as clearly shown in FIG. 5. Further, travel of each of the carrier assemblies 30 along the length of the header structure and on the interior thereof, is facilitated by two spaced-apart and oppositely disposed wheels 40 rotatably connected to the side portions 32' of the carrier frame 32 by outwardly projecting fingers or axles 42.

Each of the carrier frames 32 includes a central aperture 44 and two spaced-apart upper apertures 46 on opposite sides thereof. The apertures 46 are for cooperative passage therethrough of the cord means 28 which, as set forth above, tends to the selective positioning and movement of the various carrier assemblies 30 along the length of the header structure as well as the tilt rod 22. The central aperture 44 is disposed and dimensioned to accommodate a worm gear 46 having a curvilinear gear tooth 46' on the outer surface thereof and defining part of a gear means which causes the rotation of the support stem 18 and the vertical slat or louver 20 attached thereto about its own longitudinal axis. Each worm gear 46 associated with each of the carrier frames 32 includes an inwardly disposed and integrally formed key member 48 mounted on the worm gear 46. Such key member 48 engages the outer splined surface of the tilt rod 22 so as to cause rotation of the worm gear 46 with the tilt rod concentrically about the longitudinal axis of the tilt rod.

The gear means associated with each of the carrier assemblies further includes a stem gear 50 secured to an upper end or head portion of the stem gear and caused to be driven by rotation of the worm gear through the existence of an interconnecting gear assembly generally indicated as 52. The interconnecting gear assembly includes a first gear member 54 and a second gear member 56 disposed in mating engagement with one another by means of a first gear segment 54' and a second gear segment 56' clearly shown in both FIGS. 4 and 5. Also, as clearly shown therein, the first gear member 54 is driven by its interaction and mating engagement with the worm gear such that it will rotate about its own longitudinal axis. Due to the mating engagement between the first gear segment 54' and the second gear segment 56', rotation of the first gear member 54 will in turn cause rotation of the second gear member 56. Due to the fact that the second gear member 56 drivingly engages the stem gear 50, the stem 18 will be rotated about its own longitudinal axis as will the depending and supportive vertical louver or slat 20. The direction of rotation of the stem and slat of course depends upon the directional rotation of the tilt rod.

FIG. 4A discloses another embodiment of the interconnecting gear assembly therein generally indicated as 52'. The interconnecting gear assembly 52' of the embodiment of 54 includes a first gear member 55 and a second gear member 57 disposed in mating engagement with one another by means of a first gear segment 55' and a second gear segment 57'. Also, as clearly shown, the first gear member 55 is driven by its interaction and mating engagement with the outer surface of the worm gear 47 such that it will rotate about its own longitudinal axis. An important feature of the embodiment of FIG. 4A is the absence of any gear teeth either on the outer surface of the worm gear 47 or the outer surface of the first gear member 55. To the contrary, interaction and "mating engagement" therebetween takes place due to the fact that the respective outer surfaces of the worm gear 47 and the first gear member 55 are both roughened, abrasive such as being knurled or the like. For purposes of clarity, the member 45 and the first gear member 55 will still be referred to herein as "gear members". However, neither of these components, in the embodiment of FIG. 4A, include actual gear teeth but rather move relative to one another and therefore interact due to frictional engagement between the respective outer surfaces. The respective outer surfaces in turn may be formed of any sufficiently roughened or abrasive configuration and, as set forth above, such surfaces could be but not necessarily are knurled. Due to the mating engagement between the first gear segment 55' and the second gear segment 57', rotation of the first gear member 55 will in turn cause rotation of the second gear member 57. Due to the fact that the second gear member 57 drivingly engages the stem gear 50' the stem 18 will be rotated about its own longitudinal axis as explained with reference to the embodiment of FIGS. 4 and 5.

An important feature of the present invention is the provision of a clutch mechanism which serves to accomplish automatic alignment of all the stems 18 and vertical slats or louvers 20. Such is required for example, when one or more of the slats is displaced out of synchronized angular orientation or alignment with the remainder. This is accomplished merely by rotating the tilt rod in both of its opposite direction to its farthest extent. While continued rotating force is placed on the tilt rod, the worm gears 46 associated therewith will continue to exert a rotational force from the first gear member 54. However, when the stem 18 and associated vertical louver 20 reaches its maximum degree of rotation, it will be maintained in a stationary position. Continued force exerted on the first member 54 will cause a "riding-up" of the first gear segment 54' relative to the now stationary second gear member 56'. This will cause an upper end or protrusion 58 to be forced against the cover member 34 which now serves as a biasing member. The biasing force exerted on the upper end 58 is due to an inherent flexibility of the cover member 54. However, riding-up and displacement and relative movement of the first gear member 54 and first gear segment 54′ relative to the second gear member and gear segment 56 and 56′ respectively will occur thereby causing a clutching action to be accomplished. However, the inherent flexibility of the biasing member or cover 34 and the fact that it continuously engages the upper end or extension 58 of the first gear member 54 will constantly attempt to force the first gear segment 54′ back into driving engagement relative to the second gear segment 56′. Automatic alignment of the angular orientation of the stems 18 and their associated vertically depending and supported slats 20 will thereby be accomplished. In order to properly align the first gear member and the second gear member 54 and 56 respectively, both are mounted on and concentrically surround an integrally formed upwardly protruding finger as at 60 having its upper end 62 be disposed contiguous to or in actual engagement with the cover member 34 which, as set forth above, defines the biasing member due to its inherent flexibility. The phantom lines shown in FIG. 5 of the biasing member 34 shows its outer expansion upon the first gear member 54 riding-off the second gear member 56 due to the stationary non-rotating position of the second gear member 56′ and the continued rotation of the first gear segment 54.

Figures 6, 7, 8, 9, 11, 12, 13, 14, 15, 16:
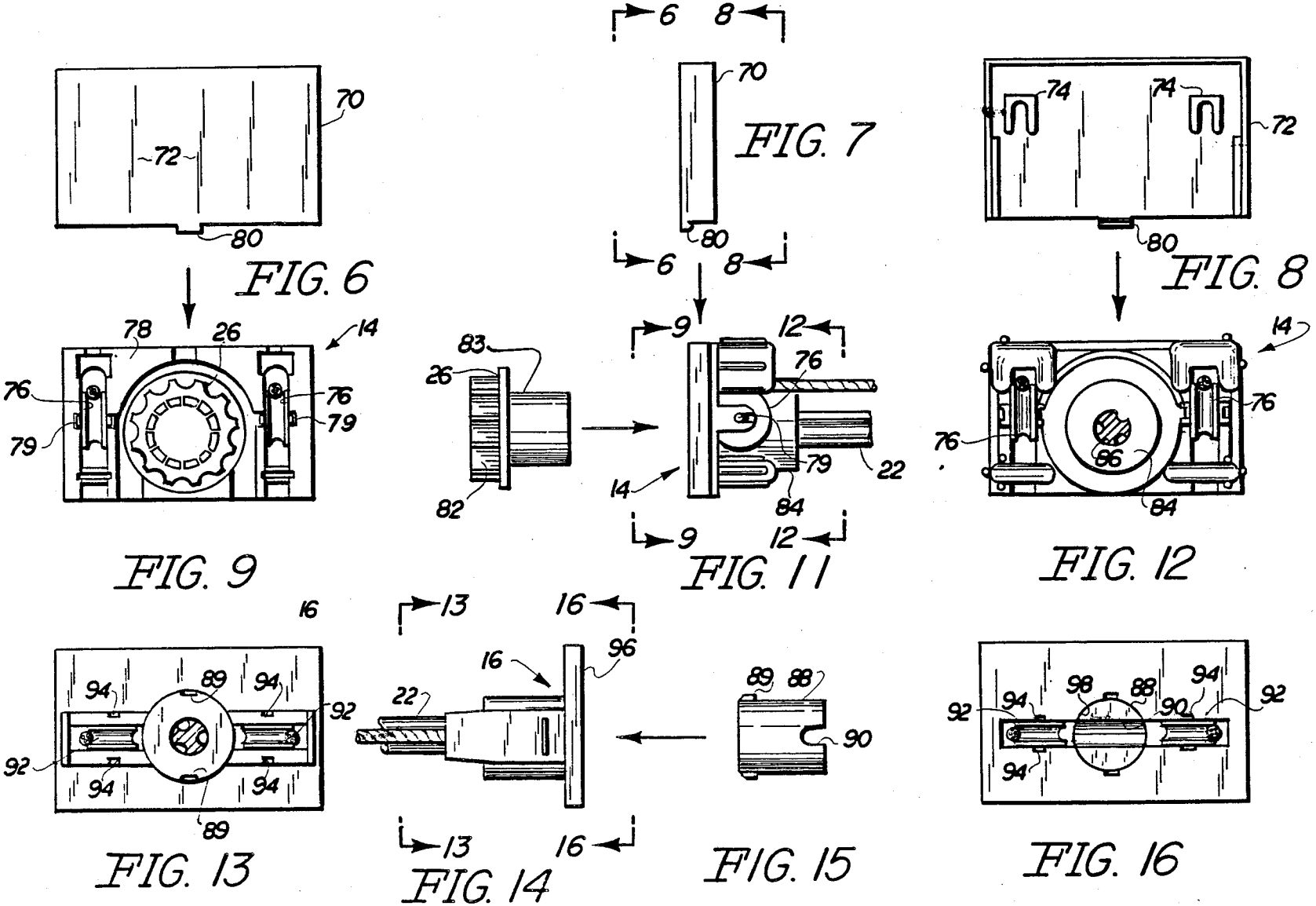
FIG. 6 is an end view of an end-cap of the control means of the present invention as shown along line 6—6 of FIG. 7.
FIG. 7 is a side view of the embodiment of FIG. 1.
FIG. 8 is a front view of the inner surface of the end-cap of FIG. 7 taken along 8—8 thereof.
FIG. 9 is a front view of the exposed components of the control means taken along line 9—9 of FIG. 11.
FIG. 11 is an end view of the embodiment of FIG. 9.
FIG. 12 is a reverse end view taken along line 12—12 of FIG. 11.
FIG. 13 is an end view of the rod support means of the present invention taken along line 13—13 of FIG. 14.
FIG. 14 is an end view of the embodiment of FIG. 13.
FIG. 15 is a detailed view of an end-stop structure associated with the support rod means.
FIG. 16 is an end view taken along line 16—16 of FIG. 14.

FIG. 6 through 12 relate to the various components of the control means 14 and include end-cap 70 having a substantially smooth outer exposed surface 72 as shown in FIG. 6 and an inner surface on which cord guides 74 are integrally formed so as to facilitate guidance and tholing of the cord 28 as it passes along the interior of the header structure 12 and over each of a pair of rollers 76. The rollers are mounted on the control frame 78 as is the sprocket gear 26. Each of the rollers 76 includes two stub axle type supports 79 mounted within appropriate elongated recesses integrally formed in the control frame 78. The end-cap 72 may be slidable in overlying relation to the remainder of the control assembly 14 as clearly shown in FIG. 2 and be snap-fitted in such position by an outwardly extending finger or like member as at 80.

The sprocket 26 has a plurality of circumferentially arranged chambers or like pockets 82 designed to receive the various ball-like elements on the pull chain 24 as is common. Manipulation of the pull chain 24 causes rotation of the sprocket 26. The sprocket has an inward extension 83 passing into the interior and movable relative to a central channel or chamber 84. The chamber is apertured as at 86 to receive a correspondingly positioned end of the tilt rod 22 therethrough. Inner engagement between the inwardly directed extension 83 of the sprocket 26 occurs by means of a push nut locking structure (not shown herein for purposes of clarity) which surrounds and firmly engages the corresponding end of the tilt rod passing through the aperture 86 into locking engagement with the inwardly directed extension 83 serving to attach the tilt rod and the sprocket in cause rotation with one another.

FIG. 13 through 16 are directed to the various components of the rod support means 16 secured to the header structure 12 at the opposite end thereof relative to the control means 14. The rod support means 16 is snap-fitted and thereby removably secured to the opposite end of the header structure 12 and includes an end-stop 88 having outwardly projecting or protruding fingers or the like 89 designed to engage and be interconnected to correspondingly positioned portions of the rod support means 16. Thereby easy removal of the end-stop 88 is provided.

An integrally formed groove as at 90 is formed on the exposed end so as to facilitate a path of travel of the cord 28 as the cord passes between the two rollers 92 rotatably mounted on and associated with the end-support 16. The two rollers include outwardly projecting stub axles as at 94 slide fitted into supported and rotating engagement relative to the elongated recesses, not shown in detail.

The exposed end of the rod support means 16 as at 96 has a central aperture 98 for the passage of the end-cap or end-support 88 therein.

Now that the invention has been described,

What is claimed is:

1. In a vertical blind assembly of the type including a plurality of vertically oriented slats suspended in depending relation from an elongated header structure and positionable along the length thereof and each slat rotatable by its own longitudinal axis, an improvement comprising:

a. an elongated tilt rod extending along the length thereof and rotatably supported at opposite ends thereof to said header structure, b. a control means secured to one end of said header structure and connected in rotational driving engagement with a corresponding end of said tilt rod for selective rotation thereof in either of two opposite directions, c. a rod support assembly mounted on an opposite, correspondingly positioned end of said header structure and connected in receiving relation to said tilt rod so as to rotate in part therewith, d. a plurality of carrier assemblies each including a carrier frame movable along the length of said header structure and having a substantially centrally disposed aperture formed therein and dimensioned to allow positioning therein in substantially central disposition of said tilt rod and a depending stem removably and rotatably mounted on said frame and depending therefrom in removable connection with one of said plurality of slats, e. a gear means movably and drivingly connecting said tilt rod to said stem for selective rotation and angular orientation of said plurality of slats relative to one another, f. said gear means including a worm gear surrounding and rotating with said tilt rod, a stem gear secured to said stem and rotatable therewith and a connecting gear assembly disposed in mating, driving engagement with said worm gear and in mating, driving engagement with said stem gear, g. said connecting gear assembly disposed in off-set, laterally adjacent relation to a central disposition of said tilt rod and worm gear and further defining a clutch mechanism, h. said clutch mechanism including a first gear member and a second gear member of said gear assembly being structured and disposed in removable mating engagement with one another, said first gear member including a protrusion rotatable with said first gear member and extending outwardly therefrom into movable engagement with a biasing member, and i. said biasing member mounted on each of said carrier frames and formed of a flexible material and disposed to normally bias said first gear member into mating engagement with said second gear member.

2. An assembly as in claim 1 wherein said first and second gear members include first and second gear segments respectively, each gear segment congruently configured and dimensioned to provide a riding-off and travel of said first gear segment relative to said second gear segment and a displacement of said first gear segment towards said biasing member causing flexure thereof when said respective stem and slat is jammed and driving rotational force continues to be exerted on said first gear member by forced rotation of said tilt rod and associated worm gear.

3. An assembly as in claim 2 wherein said biasing member of each carrier frame comprises a cover portion substantially overlying a respective one of said carrier frames in biasing engagement with said protrusion of said first gear member.

4. An assembly as in claim 3 wherein each carrier frame comprises an elongated finger integrally formed thereon and extending upwardly from a base portion thereof towards said biasing member, at least said first gear member mounted on said finger and rotatable relative thereto and to said biasing member.

5. An assembly as in claim 4 wherein said second gear member is rotatably mounted on said finger substantially adjacent said base and said first gear member is mounted in overlying removable mating engagement relative to said second gear member.

6. An assembly as in claim 5 wherein said first and second gear segments each include mating gear teeth cooperatively dimensioned and configured to cause a riding-up and detachment of said first gear segment and detached gear member over said second gear segment when said respective stem and slat is jammed and driving rotational force continues to be exerted on said first gear member by a forced rotation of said tilt rod and associated worm gear.

7. An assembly as in claim 6 wherein said gear teeth of said first and second gear segments are each configured at a 45 degree cooperative angle.

8. An assembly as in claim 1 further comprising a cord means depending downwardly from said control means and extending back therethrough and through each of said support frames into movable engagement with said rod support means, both said control means and said rod support means, including a pair of rollers, each roller of each roller pair mounted on opposite sides of said tilt rod.

9. An assembly as in claim 8 wherein said rod supporting means comprises an end stop removably snap-fitted into spaced-apart recesses formed on said rod supporting means, said end stop including two flexible material protrusions disposed in aligned relation with said recesses and disposed and structured for inherent bias outwardly away from one another into respective ones of said recesses.

10. An assembly as in claim 9 wherein said end-stop comprises a groove formed therein and extending across a rear, exposed surface thereof between and in aligned registry with respective roller pairs, said groove defining a path of travel of the cord means between said roller pair.

11. An assembly as in claim 10 wherein each roller of said roller pair associated with said rod supporting means comprises outwardly projecting stub axles extending outwardly from opposite sides thereof, each stub axle of each roller slidably received in one of two spaced-apart, parallel and co-planar received grooves.

12. An assembly as in claim 8 wherein said control means comprises a control frame and a sprocket gear rotatably mounted on said control frame and having an inner end extending inwardly into a central socket into driving engagement with the corresponding end of said tilt rod and rotatable therewith; a pull chain mounted on and rotatably driving an outer end of said sprocket gear.

13. An assembly as in claim 12 wherein said inner ends comprises a centrally disposed channel defining an interior thereof and a key element integrally formed therein, said channel dimensioned to receive and drivingly rotate the corresponding end of said tilt rods so as to rotate therewith.

14. An assembly as in claim 12 wherein said control means further comprises an end-cap removably secured in snap-fitted engagement on an outer end of said control frame in covering relation to said outer end of said sprocket gear and to an outer end of a respective one of said roller pairs associated with said control means.

15. An assembly as in claim 14 wherein said end-cap comprises two inwardly directed end flanges mounted on oppositely disposed sides thereof and two spaced apart receiving grooves formed in said control frame in receiving relation to respective ones of said inwardly directed flanges, said flanges and said grooves cooperatively disposed to define sliding engagement of said end-cap on said control frame, and said flanges further correspondingly structured with said control frame to define said snap-fitted engagement therewith.

16. An assembly as in claim 12 wherein each roller of each roller pair associated with said control means comprises outwardly projecting stub axles extending outwardly from opposite sides thereof, each stub axle of each roller slidably received in one of two spaced-apart, parallel and co-planar receiving grooves.

17. An assembly as in claim 12 wherein said control means and said rod support means includes individual push nuts defining a locking structure for passage therethrough of correspondingly positioned ends of said tilt rod for locking interconnection of said tilt rods respectively with said control means and said rod support means.

18. An assembly as in claim 2 wherein said worm gear and said first gear member each include outer surfaces absent any gear teeth, said respective outer surfaces each defined by a roughened texture surface configuration and each being disposed in fictional, mating engagement with one another.

* * * * *